United States Patent [19]

Gellenthin, Jr. et al.

[11] Patent Number: 4,913,661

[45] Date of Patent: Apr. 3, 1990

[54] NEON ELECTRODE WITH PLUG-IN CONNECTOR

[75] Inventors: Carl O. Gellenthin, Jr.; Jere D. Whorton, both of Houston, Tex.

[73] Assignee: Signeon Corporation, Houston, Tex.

[21] Appl. No.: 356,129

[22] Filed: May 24, 1989

[51] Int. Cl.[4] ..... H01R 4/24

[52] U.S. Cl. ..... 439/438; 439/816; 439/891; 439/888

[58] Field of Search ..... 439/816, 888, 891, 741, 439/751, 436–443, 130, 226, 237, 746, 744, 743, 456–459

[56] References Cited

U.S. PATENT DOCUMENTS

| | | | |
|---|---|---|---|
| 1,115,114 | 10/1914 | Russel | 439/888 |
| 1,583,697 | 5/1926 | Latham | 439/891 |
| 1,634,406 | 7/1927 | Douglas | 439/888 |
| 2,076,072 | 4/1937 | Douglas | 439/459 |
| 3,170,752 | 2/1965 | Van Horssen | 439/891 |
| 3,284,754 | 11/1966 | Buchanan | 439/436 |
| 3,748,632 | 7/1923 | Tanges, Jr. | 439/891 |
| 4,842,544 | 6/1989 | Birch et al. | 439/443 |

*Primary Examiner*—David Pirlot

[57] ABSTRACT

A high voltage electrical connector for quickly connecting a stripped back electrical conductor with a neon electrode by plug-in means including a tubular glass insulated enclosure, a metal liner in the glass enclosure, and a metal connector telescopically positioned inside of the liner. The connector includes a longitudinal opening inside and a longitudinal channel on the outside, both for receiving a bent back stripped electrical conductor. The liner includes an inwardly biased electrical contact engaging the conductor in the longitudinal channel. Rotational alignment between the connector and the liner align the biased electrical contact with the longitudinal channel.

5 Claims, 2 Drawing Sheets

NEON ELECTRODE WITH PLUG-IN CONNECTOR

BACKGROUND OF THE INVENTION

The present invention is directed to an electrical plug-in connector, and in particular to an electrical plug-in connector for connecting a high voltage conductor to an electrode such as used in the neon sign industry.

All neon signs require the connecting of a high voltage conductor to the electrodes at each end of a tube segment. Since the inception of neon tubes connection between the high voltage conducting wires and the electrodes has been made by hand twisting the wires together. The connection was left exposed until recently when plastic covers were introduced which slip over the connection. Although appearance is improved, the plastic cover does not make a more secure electrical connection between the wires.

The present invention is directed to the electrical plug-in connector which can quickly and easily connect an electrical conductor to a neon electrode and provide the necessary criteria to meet electrical codes. The present invention allows the connection to be made after the end of the electrical conductor is stripped of insulation leaving a bare end, by hand, with no special tools, in a few seconds, by persons with no special skills. The connection, although made by positive pressure contact, can be disconnected and reused.

SUMMARY

The present invention is directed to an electrical plug-in connector for connecting an electrical conductor to a neon electrode and includes a tubular glass insulator positioned so as to extend the neon tube to provide high voltage protection. A tubular electrically conductive metal liner is positioned in the glass insulating sleeve and the liner includes an inwardly biased electrical contact. The electrode wires are spot welded to the metal liner during manufacturing assembly. A metal connector is positioned inside of the liner and includes an opening in the inside and a longitudinal channel on the outside which is adapted to receive the bare end of an electrical conductor. The channel of the connector coacts with the biased electrical contact for providing an electrical connection between the conductor and the electrode.

Still a further object of the present invention is wherein the metal connector and the metal liner are longitudinally movable relative to each other, but include engaging means between the connector and the liner preventing rotation therebetween. This allows the channel of the connector holding the bare conductor to align with and direct the biased electrical contact into engagement with the electrical conductor. In addition, the biased electrical contact is sized to be biased into its coacting longitudinal channel.

Yet a further object of the present invention is wherein an electrical plug-in connector is provided for quickly and manually connecting a stripped back electrical conductor to a neon electrode without tools. A tubular glass insulating enclosure provides the necessary high voltage insulation and protection. A tubular metal liner is nonrotatably positioned in the glass enclosure to which the electrode wires are spot welded. The metal liner includes an inwardly biased electrical contact. A metal connector is telescopically positioned inside of the metal liner. The connector includes a longitudinal opening in the middle and a longitudinal channel on the outside. The opening and the channel are adapted to receive a bent back stripped conductor for holding the conductor as it is installed in the liner. The channel is wider than and coacts with the biased electrical contact to provide an electrical connection between the conductor and the electrode. Engaging means between the connector and the liner require rotational alignment therebetween for properly aligning the biased contact and the channel as the connector is inserted into the liner.

Yet a further object of the present invention is wherein a contoured plastic cap is positioned onto the electrical conductor prior to the mounting of the metal connector, and its insertion into the liner, to be then slipped along the conductor until it is well seated on the glass enclosure thereby providing a weatherproof chamber for the high voltage connection between the conductor and the electrode.

Other and further objects, features and advantages will be apparent from the following description of a presently preferred embodiment of the invention, given for the purpose of disclosure and taken in conjunction with the accompanying drawings.

DESCRIPTION OF THE PREFERRED EMBODIMENT

Figure 1:
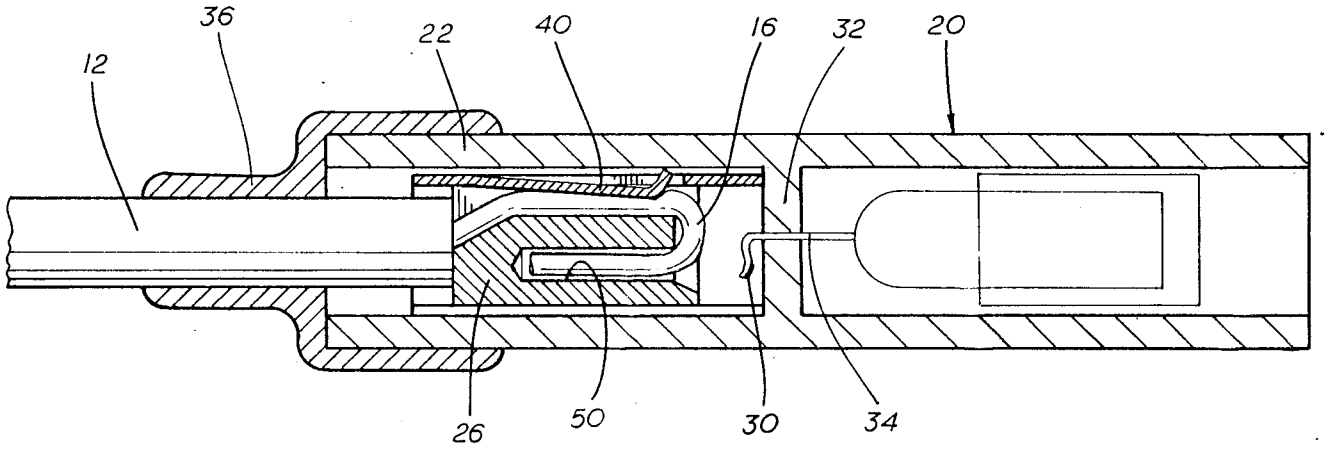
FIG. 1 is an elevational view, in cross section, illustrating the connector of the present invention connecting an electrical conductor and a neon electrode.
Figures 2, 3, 4:
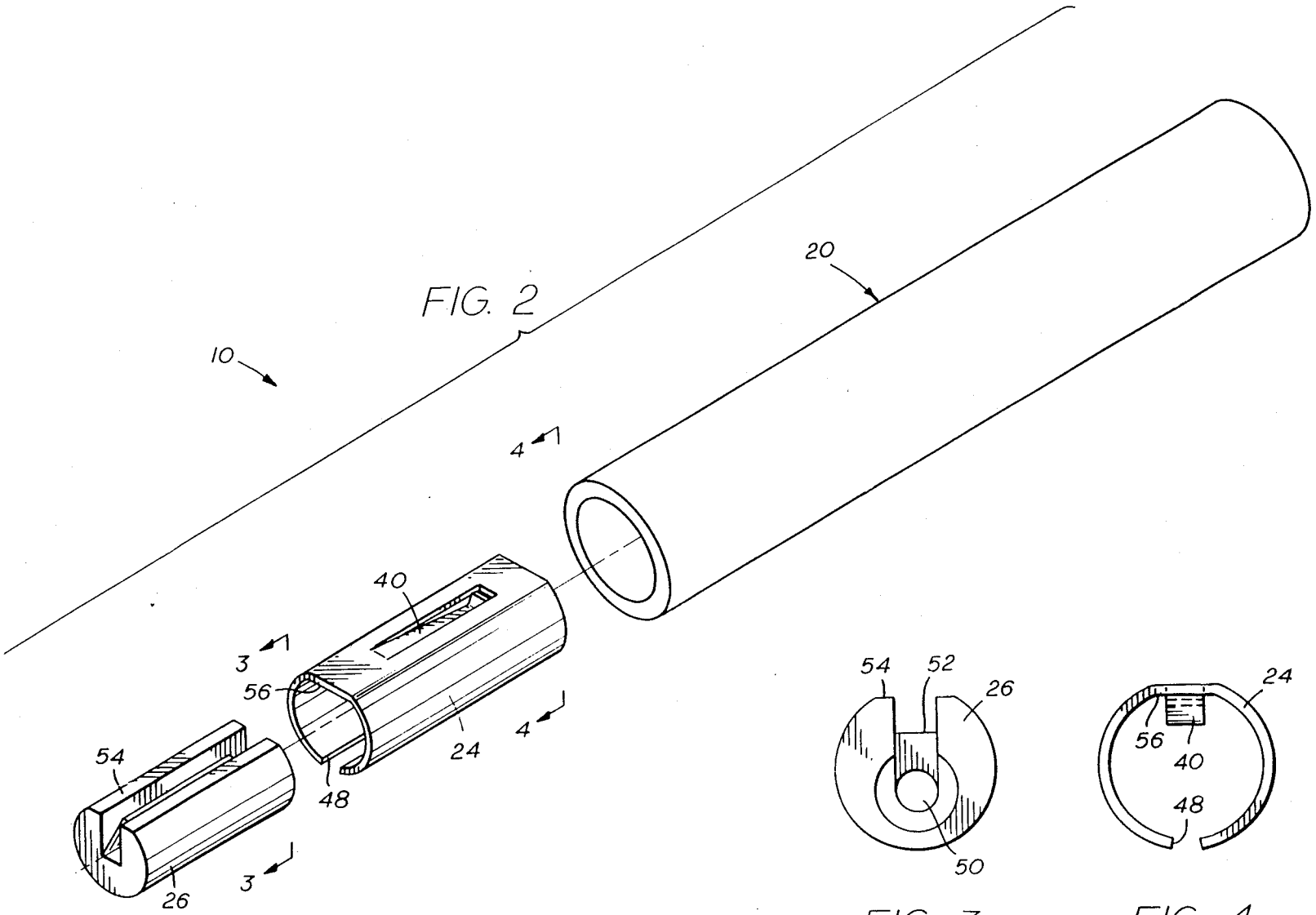
FIG. 2 is an exploded perspective view illustrating the various components of FIG. 1.
FIG. 3 is a cross-sectional view taken along the line 3—3 of FIG. 2.
FIG. 4 is a cross-sectional view taken along the line 4—4 of FIG. 2.

Referring now to the drawings, and particularly to FIGS. 1 and 2, the reference numeral 10 generally indicates the neon electrode with plug-in connector of the present invention for connecting an electrical conductor 12 to a neon electrode 20. The present connector 10 allows the connection between the conductor 12 and the neon electrode 20 to be made manually and without any tools after the conductor 12 has been stripped back to provide bare end 16.

The connector 10 generally includes a standard neon electrode 20 with continuing glass tubing 22, a metal liner 24, and a metal connector 26.

The glass tubing 22 housing the standard neon electrode 20 is allowed to continue past the sealed end 32 through which the electrode wires 34 are embedded and forms the chamber in which the metal liner 24 is inserted. The electrode wires 34 are spot welded 30 to the inner wall of the metal liner 24. The glass tubing 22 will house and enclose the electrical connection and will provide the necessary insulation to withstand the high voltage connections found in neon signs, such as 6,000–15,000 volts and 20–120 milliamp currents.

The tubular electrically conductive metal liner 24 includes an inwardly biased electrical contact 40. A non-rotatable connection is provided between the glass enclosure 22 and the metal liner 24 due to the spring action allowed by slit 48 in the metal liner 24. The liner 24 may be of any suitable conductive material such as tempered beryllium copper.

Referring now to FIGS. 1, 2, and 3, the connector 26 is shown including a longitudinal opening 50 in the interior and a longitudinal channel 52 on the exterior. The opening 50 is provided to receive a stripped conductor end 16 which, when bent back will remain in place as the connector 26 is telescopically inserted into the interior of the metal liner 24. As shown in FIG. 1, the stripped back end 16 of the conductor 12 is inserted into the opening 50 and bent back into channel 52.

It is also to be noted that there is an engaging means between the connector 26 and the metal liner 24 which prevents rotation therebetween. That is, the connector 26 includes a flat top 54 which coacts with a flat interior 56 in the liner 24. This requires that the connector 26 be rotationally aligned with the liner 24 before it can be telescopically inserted therein. The channel 52 in the connector 26 is sized slightly wider than the biased electrical contact 40. Therefore, when the connector 26 is rotationally aligned and telescopically inserted into the interior of the metal liner 24, the biased contact 40 will align with the channel 52 and make contact with the bare end 16 of the electrical conductor 12. Connector 26 may be of any suitable conductive metal such as #3 zamak. After insertion of the conductor 12 and connector 26 into the liner 24 as shown in FIG. 1, a supple fire-retardant plastic cap 36, having been positioned on the conductor 12 initially is slid into position shown on the glass tubing 22, thereby weatherproofing the connection chamber and enhancing its appearance.

The present invention provides for the quick and easy connection of an electrical conductor to the electrode of a neon lamp. The present invention is efficient, economical, and meets the criteria of codes and testing authorities, that is, a glass enclosed strong, positive connection between the conductor and the neon electrode.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A high voltage electrical connector for connecting an electrical conductor to a neon electrode comprising,
   - a tubular glass insulator for providing high voltage protection,
   - a tubular electrically conductive metal liner positioned in the glass insulator, said liner including an inwardly biased electrical contact,
   - a metal connector positioned inside of the metal liner, said connector including an opening in its interior and a longitudinal channel on its exterior, the opening and channel adapted to receive the bare end of an electrical conductor, and the channel coacting with the biased electrical contact for providing an electrical connection between the conductor and the metal liner which is an electrical extension of the neon electrode.

2. The connector of claim 1 wherein said metal connector and said metal liner are longitudinally movable relative to each other and including engaging means between said metal connector and said metal liner preventing rotation therebetween.

3. The connector of claim 1 including a non-rotatable connection between the glass isulator and the metal liner.

4. The connector of claim 1 wherein said biased electrical contact is sized to be biased into a coacting longitudinal channel.

5. A high voltage electrical connector for quickly connecting a stripped back electrical conductor to a neon electrode comprising,
   - a tubular glass insulating enclosure for providing high voltage protection,
   - a tubular electrically conductive metal liner non-rotatably positioned in the glass insulating enclosure, said liner including an inwardly biased electrical contact,
   - a metal connector telescopically positioned inside of the metal liner, said connector including a longitudinal opening in its body and a longitudinal channel on the outside, the opening and channel adapted to receive a bent back stripped conductor, the channel being wider than and coacting with the biased electrical contact of the metal liner for providing an electrical connection between the electrical conductor and a neon electrode, and engaging means between said connector and said metal liner requiring rotational alignment therebetween.

* * * * *